US009157340B2

(12) United States Patent
Smith et al.

(10) Patent No.: US 9,157,340 B2
(45) Date of Patent: Oct. 13, 2015

(54) DUAL FEED HYDRAULIC LASH ADJUSTER FOR VALVE ACTUATING MECHANISM

(71) Applicant: GT Technologies, Westland, MI (US)

(72) Inventors: Scott P. Smith, Grass Lake, MI (US); Ira R. Stoody, Roseville, MI (US)

(73) Assignee: GT TECHNOLOGIES, Westland, MI (US)

( * ) Notice: Subject to any disclaimer, the term of this patent is extended or adjusted under 35 U.S.C. 154(b) by 0 days.

(21) Appl. No.: 14/220,227

(22) Filed: Mar. 20, 2014

(65) Prior Publication Data

US 2014/0283776 A1 Sep. 25, 2014

Related U.S. Application Data

(60) Provisional application No. 61/804,806, filed on Mar. 25, 2013.

(51) Int. Cl.

| | |
|---|---|
| ***F01L 1/18*** | (2006.01) |
| ***F01L 1/24*** | (2006.01) |
| ***F01L 13/00*** | (2006.01) |

(52) U.S. Cl.

CPC ..... *F01L 1/2416* (2013.01); *F01L 1/185* (2013.01); *F01L 1/2405* (2013.01); *F01L 13/0005* (2013.01); *F01L 13/0015* (2013.01); *F01L 2001/2444* (2013.01)

(58) Field of Classification Search

CPC ..... F01L 1/2416; F01L 1/185; F01L 1/2405
USPC ..... 123/90.45, 90.46
See application file for complete search history.

(56) References Cited

U.S. PATENT DOCUMENTS

| | | | |
|---|---|---|---|
| 2,681,644 | A | 6/1954 | Purchas, Jr. et al. |
| 3,875,908 | A | 4/1975 | Ayres |
| 4,133,332 | A | 1/1979 | Benson et al. |
| 4,735,197 | A | 4/1988 | Ishida et al. |

(Continued)

FOREIGN PATENT DOCUMENTS

| | | | |
|---|---|---|---|
| DE | 103 30 510 | A1 | 1/2005 |
| DE | 10 2006 045 017 | A1 | 3/2008 |

(Continued)

OTHER PUBLICATIONS

Sep. 9, 2014 European Search Report for European Application No. 14 16 1085.

*Primary Examiner* — Ching Chang
(74) *Attorney, Agent, or Firm* — Howard & Howard Attorneys PLLC

(57) ABSTRACT

A dual feed hydraulic lash adjuster includes a plunger assembly slidingly disposed in a lash adjuster body and having an end adapted to cooperate with a valve actuating mechanism, the plunger assembly forming a low-pressure first chamber and a high-pressure second chamber with the body, the plunger assembly having a first aperture fluidly communicating with the first chamber, a passageway fluidly communicating with the first chamber, and a second aperture fluidly communicating with the passageway, and a separate fluid pressure separator disposed in the plunger assembly between the first aperture and the second aperture to prevent passage of hydraulic fluid between the first chamber and the passageway, wherein a passage is provided through the fluid pressure separator to provide for evacuation of air from the lash adjuster.

17 Claims, 4 Drawing Sheets

(56) References Cited

U.S. PATENT DOCUMENTS

| | | | | |
|---|---|---|---|---|
| 5,452,694 | A | 9/1995 | Hara | |
| 5,509,385 | A * | 4/1996 | LaVieri | 123/90.35 |
| 5,544,626 | A | 8/1996 | Diggs et al. | |
| 6,006,710 | A | 12/1999 | Stephan | |
| 6,039,017 | A | 3/2000 | Hendriksma | |
| 6,192,845 | B1 | 2/2001 | Guzak | |
| 6,325,034 | B1 | 12/2001 | Edelmayer | |
| 6,619,252 | B2 | 9/2003 | Haas et al. | |
| 7,047,925 | B2 * | 5/2006 | Hendriksma et al. | 123/90.45 |
| 7,077,090 | B2 | 7/2006 | Sailer et al. | |
| 7,146,954 | B2 | 12/2006 | Sailer et al. | |
| 7,237,520 | B2 | 7/2007 | Haefner | |
| 7,284,519 | B1 | 10/2007 | Best et al. | |
| 7,296,549 | B1 | 11/2007 | Sailer et al. | |
| 7,421,994 | B2 | 9/2008 | Harris et al. | |
| 7,464,678 | B2 | 12/2008 | Rozario et al. | |
| 7,464,679 | B2 | 12/2008 | Sailer et al. | |
| 7,637,238 | B2 | 12/2009 | Haefner et al. | |
| 7,640,906 | B2 | 1/2010 | Sailer et al. | |
| 7,685,984 | B2 | 3/2010 | Hendriksma et al. | |
| 7,992,532 | B2 | 8/2011 | Bugescu et al. | |
| 8,037,857 | B2 | 10/2011 | Sailer et al. | |
| 8,555,842 | B2 | 10/2013 | Janowiak | |
| 2005/0193973 | A1 | 9/2005 | Hendriksma et al. | |
| 2006/0081206 | A1 | 4/2006 | Sailer et al. | |
| 2006/0180110 | A1 | 8/2006 | Karbstein et al. | |
| 2007/0215087 | A1 | 9/2007 | Best et al. | |
| 2007/0272185 | A1 | 11/2007 | Best | |
| 2008/0022955 | A1 | 1/2008 | Sailer et al. | |
| 2009/0044775 | A1 | 2/2009 | Tallio et al. | |
| 2009/0083959 | A1 | 4/2009 | Sailer et al. | |
| 2010/0037845 | A1 | 2/2010 | Sailer et al. | |

FOREIGN PATENT DOCUMENTS

| | | | |
|---|---|---|---|
| DE | 10 2006 047 447 | A1 | 4/2008 |
| EP | 1 568 851 | A1 | 8/2005 |
| EP | 1 571 300 | A2 | 9/2005 |
| EP | 1 662 098 | B1 | 1/2008 |
| WO | 2007/118820 | A1 | 10/2007 |

* cited by examiner

DUAL FEED HYDRAULIC LASH ADJUSTER FOR VALVE ACTUATING MECHANISM

CROSS-REFERENCE TO RELATED APPLICATION(S)

This application claims the benefit of U.S. provisional patent application entitled "Dual Feed Hydraulic Lash Adjuster for Valve Actuating Mechanism," having Ser. No. 61/804,806, and filed on Mar. 25, 2013.

BACKGROUND OF THE INVENTION

1. Field of the Invention

The present invention relates generally to valve actuating mechanisms for engines and, more particularly, to a dual feed hydraulic lash adjuster for a valve actuating mechanism for an internal combustion engine.

2. Description of the Related Art

It is known to provide valve actuating mechanisms to open and close valves of an engine such as an internal combustion engine. These valve actuating mechanisms may be of a finger follower type including a finger follower having a pallet or web engaging a stem of the valve and a dome socket engaging a rounded end of a hydraulic lash adjuster (HLA) supported by a cylinder head of the engine. The dome socket is known to have a dome with a concave recess or socket therein. Typically, a circular opening or orifice is provided in the dome for spraying hydraulic fluid supplied by the HLA from the socket into a camshaft compartment for lubricating a cam and cam follower and associated components of the valve actuating mechanism.

Hydraulic lash adjusters for variable lift valve actuating mechanisms for internal combustion engines are well known. Typically, the hydraulic lash adjuster (HLA) is disposed on an engine block of the engine. The HLA generally comprises a slidable plunger that may be hydraulically extended to take up mechanical lash in a valve train for the engine. In an example where a valve lift change is accomplished by increasing fluid pressure to the associated variable lift valve actuating mechanism, the HLA is supplied with low-pressure engine fluid for conventional lubrication and lash adjustment. When a valve lift change is desired, fluid pressure in the HLA is increased, and high-pressure fluid flows through the same circuit in the HLA to actuate the variable lift valve actuating mechanism. To reverse the change, the fluid pressure is again reduced.

A problem exists in some conventional HLA assemblies having a single fluid feed wherein the hydraulic fluid pressure is varied between the two modes. Because a minimum lash-adjusting hydraulic fluid pressure is present in the HLA at all times, the minimum required switching pressure must include the HLA minimum pressure. That is, the minimum required switching pressure must be higher than in other known systems wherein the lash adjuster and the switching element are independently supplied. Thus, providing dual independent fluid supply to a hydraulic lash adjuster represents an advance in the art.

U.S. Pat. No. 7,047,925 to Hendriksma discloses a dual feed hydraulic lash adjuster. In this patent, a dual feed hydraulic lash adjuster (HLA) for use in an internal combustion engine includes a hollow body and a plunger assembly disposed in a bore of the engine. A one-piece plunger body includes a first chamber for forming a low-pressure fluid reservoir and receiving a lash adjustment mechanism, and a second chamber open at one end and partially closed hemispherically for supporting a rocker arm and providing valve deactivating fluid thereto for an auxiliary valve actuation system. The first and second chambers are separated by a transverse web, optionally having a small-diameter passage therethrough for air evacuation.

The above-described patented dual feed hydraulic lash adjuster suffers from the disadvantage that there is no separate fluid pressure separator. Another disadvantage of the dual feed hydraulic lash adjuster is that there is only a fixed web between chambers of a plunger assembly, which is undesired. A further disadvantage of the dual feed hydraulic lash adjuster is that it has a one-piece plunger body, which is undesired.

Therefore, it is desirable to provide a new dual feed hydraulic lash adjuster in a valve actuating mechanism for an internal combustion engine. It is also desirable to provide a dual feed hydraulic lash adjuster that has a separate fluid pressure separator for the hydraulic fluid. It is further desirable to provide a dual feed hydraulic lash adjuster with separation between the fluid feeds for lubrication that optionally provides air evacuation. Thus, there is a need in the art to provide a dual feed hydraulic lash adjuster in a valve actuating mechanism for an internal combustion engine that meets at least one of these desires.

SUMMARY OF THE INVENTION

It is, therefore, one object of the present invention to provide a dual feed hydraulic lash adjuster in a valve actuating mechanism for an internal combustion engine.

It is another object of the present invention to provide a dual feed hydraulic lash adjuster in a valve actuating mechanism for an internal combustion engine that has a separate fluid pressure separator that allows for air evacuation.

To achieve one or more of the foregoing objects, the present invention is a plunger assembly for a dual feed hydraulic lash adjuster including a lower plunger element adapted to be slidingly disposed in a body of the lash adjuster and an upper plunger element adapted to be slidingly disposed in the body of the lash adjuster and having an end adapted to cooperate with a valve actuating mechanism. The upper plunger element cooperates with the lower plunger element to form a low-pressure chamber. The upper plunger element has a first aperture fluidly communicating with the first chamber, a passageway fluidly communicating with the low-pressure chamber and the end, and a second aperture fluidly communicating with the passageway. The plunger assembly further includes a separate fluid pressure separator disposed in the upper plunger element between the first aperture and the second aperture to prevent passage of hydraulic fluid between the low-pressure chamber and the passageway, wherein a passage is provided through the fluid pressure separator to provide for evacuation of air from the lash adjuster.

Also, the present invention is a dual feed hydraulic lash adjuster including a lash adjuster body adapted to be supported by an internal combustion engine and having a bore extending axially therein. The dual feed hydraulic lash adjuster also includes a plunger assembly having a lower plunger element and an upper plunger element slidingly disposed in the bore of the body with an end adapted to cooperate with a valve actuating mechanism. The upper plunger element cooperates with the lower plunger element and forms a low-pressure first chamber and a high-pressure second chamber with the body. The upper plunger element has a first aperture fluidly communicating with the first chamber, a passageway fluidly communicating with the first chamber and the end, and a second aperture fluidly communicating with the passageway. The body includes a first port adapted for passage of hydraulic fluid from a first source to the first aperture and a second port for passage of hydraulic fluid from a second source to the second aperture. The dual feed hydraulic lash adjuster further includes a separate fluid pressure separator disposed in the plunger assembly between the first aperture and the second aperture to prevent passage of hydraulic fluid between the first chamber and the passageway, wherein a passage is provided through the fluid pressure separator to provide for evacuation of air from the lash adjuster.

In addition, the present invention is an internal combustion engine including a valve train, a valve actuating mechanism for deactivating the valve train, an engine block having an axial bore, and a dual feed hydraulic lash adjuster disposed in the axial bore for eliminating lash in the valve train and for providing hydraulic fluid to the valve actuating mechanism. The lash adjuster includes a lash adjuster body supported by the engine block and a plunger assembly including a lower plunger element and an upper plunger element slidingly disposed in the body and having an end cooperating with the valve actuating mechanism. The upper plunger element cooperates with the lower plunger element and forms a low-pressure first chamber and forms a high-pressure second chamber with the body. The upper plunger element has a first aperture fluidly communicating with the first chamber, a passageway fluidly communicating with the first chamber, and a second aperture fluidly communicating with the passageway. The body includes a first port for passage of hydraulic fluid from a first source to the first aperture and a second port for passage of hydraulic fluid from a second source to the second aperture. The lash adjuster further includes a separate fluid pressure separator disposed in the plunger assembly between the first aperture and the second aperture to prevent passage of hydraulic fluid between the first chamber and the passageway, wherein a passage is provided through the fluid pressure separator to provide for evacuation of air from the lash adjuster One advantage of the present invention is that a new dual feed hydraulic lash adjuster is provided for a valve actuating mechanism in an internal combustion engine. Another advantage of the present invention is that the dual feed hydraulic lash adjuster has dual feed hydraulic fluid operation. Yet another advantage of the present invention is that the dual feed hydraulic lash adjuster includes a separate fluid pressure separator optionally having a small-diameter passage therethrough for purging of air from the lash adjuster. A further advantage of the present invention is that the dual feed hydraulic lash adjuster has dual hydraulic fluid grooves, dual plunger hydraulic fluid feed apertures, and a separate hydraulic fluid pressure separator.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT(S)

Figure 1:
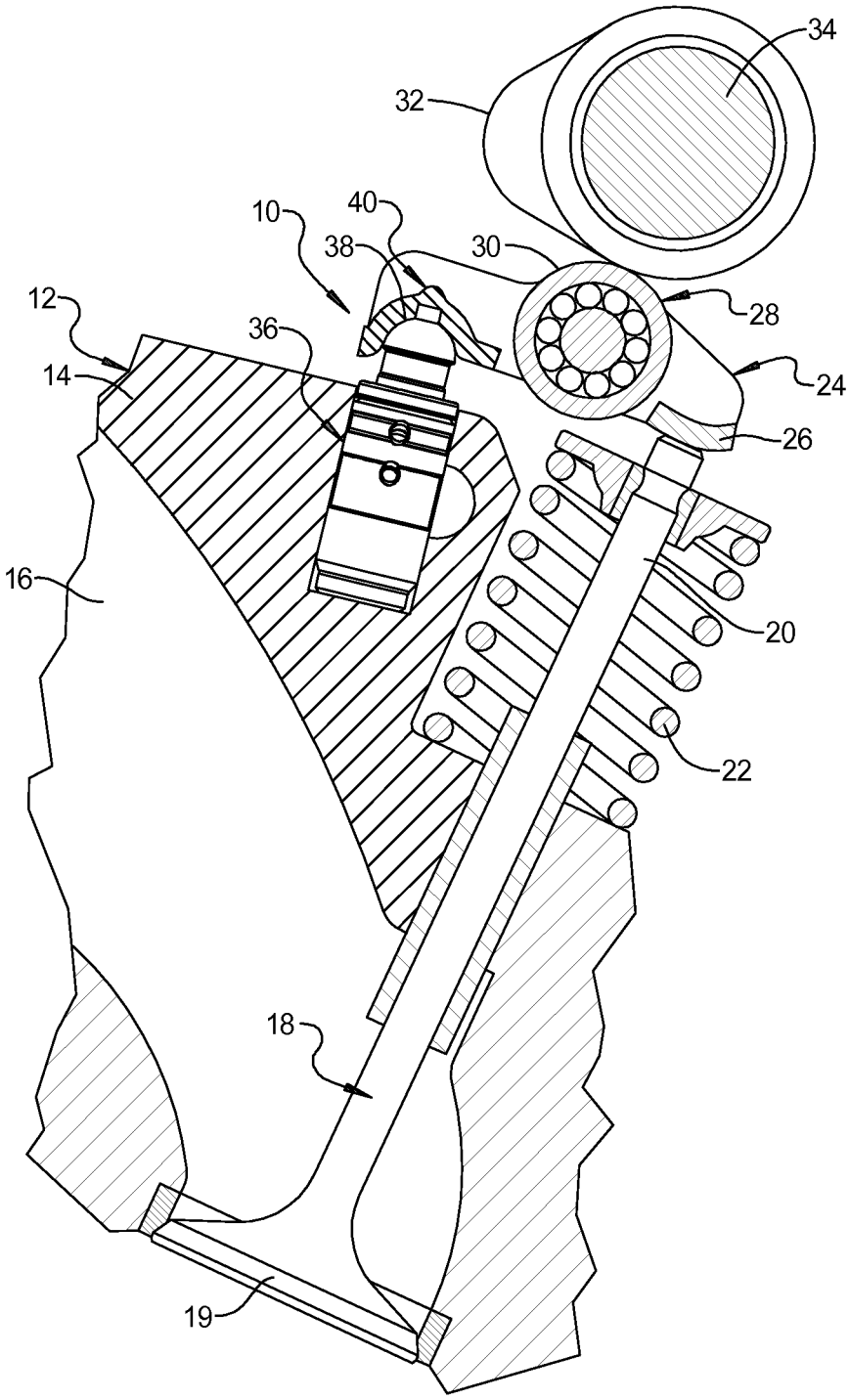
FIG. 1 is a fragmentary view a dual feed hydraulic lash adjuster, according to the present invention, illustrated in operational relationship with a valve actuating mechanism and a portion of an engine.

Referring now to the drawings, and in particular FIG. 1, one embodiment of a valve actuating mechanism 10 of a finger follower type is shown for an internal combustion engine, generally indicated at 12. The engine 12 is of an overhead cam type having a cylinder head 14 including an inlet or exhaust port 16. The engine 12 also includes a valve 18 having a head 19 and a stem 20 extending from the head 19. The engine 12 includes a spring 22 disposed about the stem 20 that biases the head 19 of the valve 18 to a closed position. The valve actuating mechanism 10 also includes a finger follower, generally indicated at 24, having a pallet or actuating pad 26 engaging the stem 20 of the valve 18. The valve actuating mechanism 10 further includes a roller cam follower 28 having an outer surface 30 engaged by an associated cam 32 of a camshaft 34.

A dual feed hydraulic lash adjuster, according to the present invention and generally indicated at 36, is supported by the cylinder head 14 and has a rounded end 38. The finger follower 24 includes a dome socket, generally indicated at 40, engaging the rounded end 38 of the dual feed hydraulic lash adjuster 36. The dome socket 40 includes a dome having a domed outer surface and a generally spherical lower recess or socket for engaging the rounded end 38 of the dual feed hydraulic lash adjuster 36. The dome socket 40 also includes a spray orifice in the dome that fluidly communicates with the socket and the exterior of the dome. It should be appreciated that the socket receives hydraulic fluid via the dual feed hydraulic lash adjuster 36 and the fluid is sprayed through the spray orifice. It should be appreciated that the dome socket 40 is supported by the finger follower 24.

Figure 2:
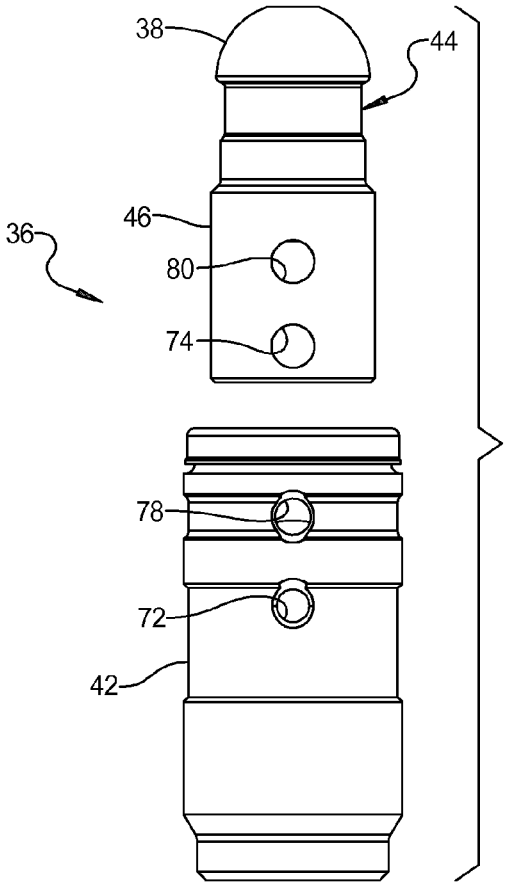
FIG. 2 is an exploded view of the dual feed hydraulic lash adjuster, according to the present invention, of FIG. 1.
Figure 4:
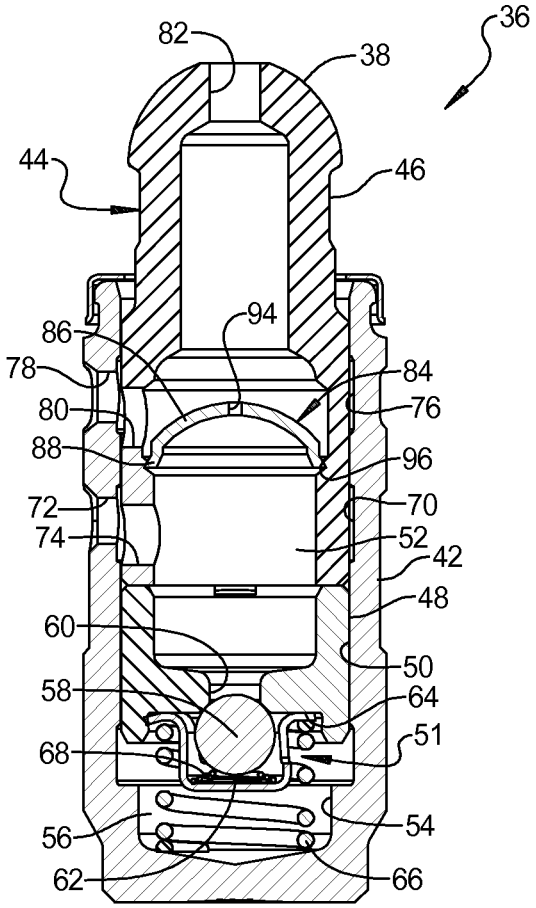
FIG. 4 is a sectional view of the dual feed hydraulic lash adjuster, according to the present invention, of FIGS. 1 and 2.

As illustrated in FIGS. 2 and 4, one embodiment of the dual feed hydraulic lash adjuster 36, according to the present invention, is shown. The dual feed hydraulic lash adjuster 36 includes a lash adjuster body 42 disposed in a bore of the cylinder head 14 of the engine 12 and a plunger assembly, generally designated as 44, which is slidingly disposed within the body 42. The plunger assembly 44 includes an upper plunger element 46 and a lower plunger element 48. The plunger elements 46 and 48 are received within the body 42 in a close-fitting relationship within a bore 50 of the body 42. The dual feed hydraulic lash adjuster 44 also includes a lash adjustment mechanism (LAM), generally indicated at 51. The LAM 51, upper and lower plunger elements 46, 48 define a first or low-pressure chamber 52 therebetween. The bottom of lower plunger element 48 forms, in cooperation with the end of a reduced diameter portion 54 of the bore 50, a second or high-pressure chamber 56. The LAM 51 includes a check valve 58 disposed in the end of a passage 60 that connects the high-pressure chamber 56 and the low-pressure chamber 52. The LAM 51 also includes a cage 62 to retain the check valve 58, which is in an interference fit within a counterbore 64 formed in the lower plunger element 48. The LAM 51 includes a lash adjuster plunger spring 66 seated in the cage 62. The LAM 51 further includes a bias spring 68 to bias the check valve 58 into a normally closed position. It should be appreciated that the upper plunger element 46 and the lower plunger element 48 are separate members.

The body 42 includes a first annular collector groove 70 and first entrance port 72 for supplying lash-adjusting fluid to the first chamber 52. The first entrance port 72 in the body 42 opens into the bore 50 and intersects the first annular collector groove 70 which, in turn, intersects a first radial port or aperture 74 in the upper plunger element 46 to supply hydraulic fluid from a first source (not shown) to the low-pressure chamber 52. The body 42 also includes a second annular collector groove 76 and second entrance port 78 for supplying oil for the auxiliary valve actuation system to the second chamber 56. The second entrance port 78 opens into the bore 50 of the body 42 and intersects the second collector groove 76 which, in turn, intersects a second radial port or aperture 80 in the upper plunger element 46 to provide hydraulic fluid from a second source (not shown) to an axial passageway 82 open at one end for providing hydraulic fluid such as oil to the valve actuating mechanism 10. The other end of the axial passageway 82 fluidly communicates with the first chamber 52. It should be appreciated that the surface of the dome socket 40 engages the rounded end 38 formed on the upper plunger element 46, hydraulic fluid being passable through the passageway 82.

Figure 3:
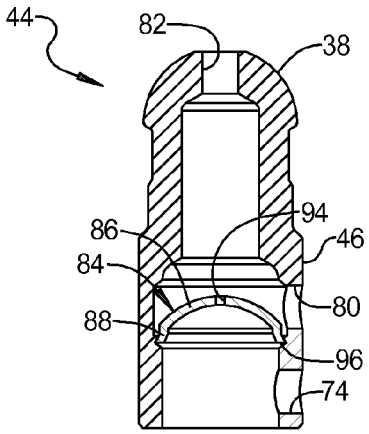
FIG. 3 is a sectional view of a portion of a plunger assembly, according to the present invention, of the dual feed hydraulic lash adjuster of FIGS. 1 and 2.
Figure 5:
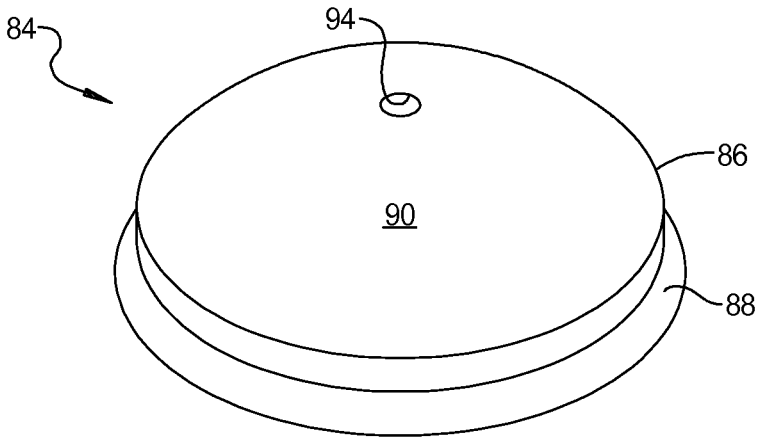
FIG. 5 is an isometric view of a fluid pressure separator, according to the present invention, of the dual feed hydraulic lash adjuster of FIGS. 1 through 4.
Figure 6:
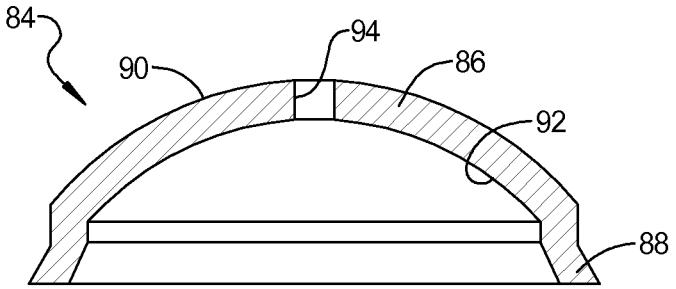
FIG. 6 is a sectional view of the fluid pressure separator, according to the present invention, of the dual feed hydraulic lash adjuster of FIGS. 1 through 4.

Referring to FIGS. 3 through 5, the dual feed hydraulic lash adjuster 36 includes a separate fluid pressure separator, generally indicated at 84, disposed in the upper plunger element 48 between the first aperture 74 and the second aperture 80 to prevent passage of hydraulic fluid between the low-pressure chamber 52 and the passageway 82. The fluid pressure separator 84 is generally hemispherical in shape. The fluid pressure separator 84 has a dome portion 86 and a flange portion 88 extending outwardly from the dome portion 86. The dome portion 86 has a domed outer surface 90 and a generally spherical lower recess or socket 92. Optionally, a small-diameter passage 94 extends axially through the dome portion 86 of the fluid pressure separator 78 to permit air to bleed out of or purging of air from the LAM 51. The fluid pressure separator 84 is disposed in the upper plunger element 46 between the apertures 74 and 80 and the flange portion 88 is disposed in an inwardly extending annular groove 96 in the upper plunger element 46 to secure the fluid pressure separator 84 in place. It should be appreciated that the first and second apertures 74 and 80 are separated transversely by the fluid pressure separator 84.

In operation of the valve actuation mechanism 10, the camshaft 34 of the engine 12 rotates and a cam 32 of the camshaft 34 actuates the finger follower 24. The dual feed hydraulic lash adjuster 36 acts as a pivot about which the finger follower 24 is actuated to open and close an associated valve 18 of the engine 12. Lubrication fluid from the dual feed hydraulic lash adjuster 36 is provided to the recess or socket through an opening (not shown) in the rounded end 38 of the lash adjuster 36. The fluid in the socket of the dome socket 40 is sprayed through the orifice in the dome socket 42 into the camshaft compartment for lubricating the cam 32 and cam follower 34 and associated components of the valve actuating mechanism 10.

Further in operation, hydraulic fluid for the dual feed hydraulic lash adjuster 36 is provided from a first source at a first pressure to the low-pressure first chamber 52 via the first entrance port 72, annular collector groove 70, and first aperture 74. Preferably, this fluid pressure is continuously available during operation of the engine 12. The lash adjustment spring 66 urges the lower plunger element 48 away from the bottom of the body 42 and thereby urges the upper plunger element 46 axially of the body 42 until mechanical lash is removed from the valve train. The pressure of the hydraulic fluid in the first chamber 52 overcomes the bias spring 68 and fills the high-pressure second chamber 54, conventionally making the lash adjuster 36 hydraulically rigid. When an engine control module (not shown) signals the need to engage the valve actuating mechanism 10, hydraulic fluid is provided from a second source, which may be at a higher pressure than fluid from the first source, through the second entrance port 78, annular collector groove 76, second aperture 80, and passageway 82 to the valve actuating mechanism 10. When engagement of the valve actuating mechanism 10 is no longer required, the second source is shut off from the LAM 51, and pressure is relieved via leakage at mechanical joints in the valve train, and hydraulic fluid drains to a sump (not shown).

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A plunger assembly for a dual feed hydraulic lash adjuster comprising:

a lower plunger element adapted to be slidingly disposed in a body of the dual feed hydraulic lash adjuster;

an upper plunger element adapted to be slidingly disposed in the body of the dual feed hydraulic lash adjuster and having an end adapted to cooperate with a valve actuating mechanism, said upper plunger element cooperating with said lower plunger element to form a low-pressure chamber;

said upper plunger element having a first aperture fluidly communicating with said low-pressure chamber, a passageway fluidly communicating with said low-pressure chamber and said end, and a second aperture fluidly communicating with said passageway; and a separate fluid pressure separator disposed in said upper plunger element between said first aperture and said second aperture to prevent passage of hydraulic fluid between said low-pressure chamber and said passageway, wherein said fluid pressure separator has a dome portion and a flange portion extending outwardly from said dome portion, and wherein a passage is provided through said dome portion to provide for evacuation of air from the lash adjuster.

2. A plunger assembly as set forth in claim 1 wherein said first aperture in said upper plunger element is adapted to intersect a first annular collector groove in the body to supply hydraulic fluid from a first source to said low-pressure chamber.

3. A plunger assembly as set forth in claim 2 wherein said second aperture is spaced axially from said first aperture in said upper plunger element and is adapted to intersect a second annular collector groove in the body to provide hydraulic fluid from a second source to said passageway.

4. A plunger assembly as set forth in claim 1 wherein said dome portion has a domed outer surface and a lower recess, said passage extending axially through said dome portion between said lower recess and said doomed outer surface.

5. A plunger assembly as set forth in claim 1 wherein said upper plunger element includes an inwardly extending annular groove.

6. A plunger assembly as set forth in claim 5 wherein said flange portion extends radially and is disposed in said inwardly extending annular groove of said upper plunger element to secure said fluid pressure separator in said upper plunger element.

7. A dual feed hydraulic lash adjuster comprising:

a lash adjuster body adapted to be supported by an internal combustion engine and having a bore extending axially therein;

a plunger assembly including a lower plunger element and an upper plunger element slidingly disposed in said bore of said lash adjuster body and having an end adapted to cooperate with a valve actuating mechanism, said upper plunger element cooperating with said lower plunger element to form a first chamber, and said lower plunger element cooperating with said bore of said lash adjuster body to form a second chamber;

said upper plunger element having a first aperture fluidly communicating with said first chamber, a passageway fluidly communicating with said first chamber and said end, and a second aperture fluidly communicating with said passageway;

said lash adjuster body including a first port adapted for passage of hydraulic fluid from a first source to said first aperture and a second port adapted for passage of hydraulic fluid from a second source to said second aperture; and a separate fluid pressure separator disposed in said plunger assembly between said first aperture and said second aperture to prevent passage of hydraulic fluid between said first chamber and said passageway, wherein said fluid pressure separator has a dome portion and a flange portion extending outwardly from said dome portion, and wherein a passage is provided through said dome portion to provide for evacuation of air from said lash adjuster.

8. A dual feed hydraulic lash adjuster as set forth in claim 7 wherein said lash adjuster body includes a first annular collector groove and said first aperture opens into said bore and intersects said first annular collector groove, said first annular collector groove intersecting said first aperture.

9. A dual feed hydraulic lash adjuster as set forth in claim 8 wherein said lash adjuster body includes a second annular collector groove spaced axially from said first annular collector groove and said second aperture opening into said bore of said body and intersecting said second collector groove, said second annular collector groove intersecting said second aperture.

10. A dual feed hydraulic lash adjuster as set forth in claim 7 wherein said dome portion has a domed outer surface and a lower recess, said passage extending axially through said dome portion between said lower recess and said domed outer surface.

11. A dual feed hydraulic lash adjuster as set forth in claim 7 wherein said upper plunger element includes an inwardly extending annular groove.

12. A dual feed hydraulic lash adjuster as set forth in claim 11 wherein said flange portion extends radially and is disposed in said inwardly extending annular groove in said upper plunger element to secure said fluid pressure separator in said upper plunger element.

13. An internal combustion engine comprising:

a valve train;

a valve actuating mechanism for deactivating said valve train;

an engine block having an axial bore;

a dual feed hydraulic lash adjuster disposed in said axial bore for eliminating lash in said valve train and for providing hydraulic fluid to said valve actuating mechanism;

said dual feed hydraulic adjuster including a lash adjuster body having a bore extending axially therein with said dual feed hydraulic adjuster body supported by said engine block, said dual feed hydraulic adjuster having a plunger assembly including a lower plunger element and an upper plunger element slidingly disposed in said bore of said lash adjuster body and having an end cooperating with said valve actuating mechanism, said upper plunger element cooperating with said lower plunger element to form a first chamber, and said lower plunger element cooperating with said bore of said body to form a second chamber;

said upper plunger element having a first aperture fluidly communicating with said first chamber, a passageway fluidly communicating with said first chamber, and a second aperture fluidly communicating with said passageway;

said body including a first port for passage of hydraulic fluid from a first source to said first aperture and a second port for passage of hydraulic fluid from a second source to said second aperture; and a separate fluid pressure separator disposed in said plunger assembly between said first aperture and said second aperture to prevent passage of hydraulic fluid between said first chamber and said passageway, wherein said fluid pressure separator has a dome portion and a flange portion extending outwardly from said dome portion, and wherein a passage is provided through said dome portion to provide for evacuation of air from said lash adjuster.

14. An internal combustion engine as set forth in claim 13 wherein said body includes a first annular collector groove and said first aperture opens into said lash adjuster body and intersects said first annular collector groove, said first annular collector groove intersecting said first aperture.

15. An internal combustion engine as set forth in claim 14 wherein said lash adjuster body includes a second annular collector groove spaced axially from said first annular collector groove and said second aperture opening into said body and intersecting said second annular collector groove, said second annular collector groove intersecting said second aperture.

16. An internal combustion engine as set forth in claim 13 wherein said dome portion has a domed outer surface and a lower recess, said passage extending axially through said dome portion between said lower recess and said doomed outer surface.

17. An internal combustion engine as set forth in claim 16 wherein said upper plunger element includes an inwardly extending annular groove and said flange portion extends radially and is disposed in said inwardly extending annular groove in said upper plunger element to secure said fluid pressure separator in said upper plunger element.

* * * * *

UNITED STATES PATENT AND TRADEMARK OFFICE

CERTIFICATE OF CORRECTION

PATENT NO. : 9,157,340 B2
APPLICATION NO. : 14/220227
DATED : October 13, 2015
INVENTOR(S) : Smith et al.

It is certified that error appears in the above-identified patent and that said Letters Patent is hereby corrected as shown below:

IN THE CLAIMS:

Column 8, line 5, Claim 13, delete "said dual feed hydraulic adjuster" and insert -- said dual feed hydraulic lash adjuster --

Column 8, line 7, Claim 13, delete "said dual feed hydraulic adjuster body" and insert -- said lash adjuster body --

Column 8, line 8, Claim 13, delete "said dual feed hydraulic adjuster" and insert -- said dual feed hydraulic lash adjuster --

Signed and Sealed this
Seventh Day of June, 2016

Michelle K. Lee

Michelle K. Lee
*Director of the United States Patent and Trademark Office*